US007999785B2

(12) United States Patent
Ye et al.

(10) Patent No.: US 7,999,785 B2
(45) Date of Patent: Aug. 16, 2011

(54) LIGHT-SOURCE MODULE FOR DISPLAY DEVICE AND DISPLAY DEVICE HAVING THE SAME

(75) Inventors: Byoung-Dae Ye, Yongin-si (KR); Gi-Cherl Kim, Yongin-si (KR); Eui-Jeong Kang, Asan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 568 days.

(21) Appl. No.: 12/166,506

(22) Filed: Jul. 2, 2008

(65) Prior Publication Data

US 2009/0021183 A1 Jan. 22, 2009

(30) Foreign Application Priority Data

Jul. 20, 2007 (KR) ..... 10-2007-0072999

(51) Int. Cl.
*G09G 3/36* (2006.01)

(52) U.S. Cl. ..... 345/102; 315/308

(58) Field of Classification Search ..... 315/209 R, 315/291, 307, 308, 312, 324; 345/102, 55, 345/60, 76, 77, 80, 82, 84, 87, 90, 204, 214
See application file for complete search history.

(56) References Cited

U.S. PATENT DOCUMENTS 7,609,237 B2 * 10/2009 Ragonesi et al. ..... 345/82
2004/0164685 A1 8/2004 Dygert
2004/0213015 A1 10/2004 Ito et al.
2004/0251854 A1 * 12/2004 Matsuda et al. ..... 315/291
2007/0080911 A1 4/2007 Liu et al.

FOREIGN PATENT DOCUMENTS

DE 102004032456 4/2006
WO 2006112459 10/2006

OTHER PUBLICATIONS

Search Report issued by the EPO on Jun. 18, 2010 corresponding to European Patent Application No. 08012742.6.

* cited by examiner

*Primary Examiner* — Thuy Vinh Tran
(74) *Attorney, Agent, or Firm* — F. Chau & Associates, LLC

(57) ABSTRACT

A light-source module for a display device and a display device having the same, in which the light-source module includes a plurality of light-emitting units, a current difference controller, and a converter. The light-emitting units are connected in parallel between a driving power input terminal and a ground terminal to emit light by the diving power and to output respective feedback control signals. The current difference controller is configured to output a plurality of power control signals according to the respective feedback control signals. The converter is configured to change a current of the driving power provided to the light-emitting units according to the power control signals. The amounts of currents flowing through the light emitting units each having a plurality of light emitting diodes are measured and the levels of voltages applied to the light-emitting units are changed according to the measurement results. Accordingly, a current difference between the light emitting units can be reduced and the brightness uniformity of the light source can be improved.

21 Claims, 5 Drawing Sheets

LIGHT-SOURCE MODULE FOR DISPLAY DEVICE AND DISPLAY DEVICE HAVING THE SAME

CROSS-REFERENCE TO RELATED APPLICATION

This application claims priority to Korean Patent Application No. 10-2007-0072999 filed on Jul. 20, 2007 and all the benefits accruing therefrom under 35 U.S.C. §119, the contents of which are incorporated by reference in their entirety.

BACKGROUND

The present disclosure relates to a light-source module for a display device and a display device having the same and, more particularly, to a light-source module for a display device that can reduce a current difference between a plurality of light emitting diode ("LED") strings by detecting currents flowing through the LED strings.

A liquid crystal display ("LCD"), which is one kind of flat panel display, is a light receiving device that is not self-luminescent. Thus, the LCD displays images using light supplied from a separate light-source module, for example, a backlight assembly. The light-source module includes a light-source and a light source driver driving the light source. To achieve light weight and for compactness, the light-source module uses an LED string, which has a plurality of LEDs connected in series, as the light source. A plurality of LED strings are connected in parallel in order to fabricate a planar light source.

In the related art, a light-source module is configured to control the total current of the LED strings that are connected in parallel. Therefore, if any one of the LED strings malfunctions, the light uniformity of the light source is degraded. For example, assuming that the light-source module has three LED stings, there is a case where the amount of a current flowing through the first LED string decreases due to a malfunction of the first LED string. In this case, the amounts of currents flowing through the second and third LED strings increase, because the total current amount is constant. Thus, the brightness of the first LED string decreases and the brightness of the second and third LED strings increases, leading to the non-uniformity of the brightness of the light source. Moreover, the LEDs of the second and third LED strings with an increased current will degrade more rapidly than the LEDs of the first LED string with a reduced current.

SUMMARY

An exemplary embodiment of the present invention provides a light-source module for a display device and a display device having the same. The light source module includes LED strings each having a plurality of LEDs and controls a current flowing through the LED strings, thereby reducing a current difference between the LED stings and providing the brightness uniformity of the light source.

In accordance with an exemplary embodiment, a light-source module includes: a plurality of light emitting units connected in parallel between a driving power input terminal and a ground terminal to emit light using the driving power and to output respective feedback control signals; a current difference controller configured to output a plurality of power control signals according to the respective feedback control signals; and a converter configured to change a current of the driving power provided to the plurality of light emitting units according to the power control signals.

Each of the light emitting units may include: a control node configured to output the feedback control signal; an LED string including a plurality of LEDs and connected between the driving power input terminal and the control node; and a power detector connected between the control node and the ground terminal.

The current difference controller may output a plurality of power control signals having a first voltage level if the voltage levels of the feedback control signals are within a predetermined operating range, and may output a plurality of power control signals having a second voltage level if the voltage level of at least one of the feedback control signals is out of the predetermined operating range.

The current difference controller may output a first power control signal having the second voltage level if the voltage level of at least one of the feedback control signals is lower than the lower limit of the predetermined operating range, and may output a second power control signal having the second voltage level if the voltage level of at least one of the feedback control signals is higher than the upper limit of the predetermined operating range.

The converter may increase the voltage level of the driving power according to the first power control signal having the second voltage level, and may decrease the voltage level of the driving power according to the second power control signal having the second voltage level.

The predetermined operating range may have the upper and lower limits of the current amount of the driving power selected so as to maintain the brightness uniformity of the light emitting units.

The current difference controller may output the power control signals using at least one reference voltage and the feedback control signals.

The current difference controller may include: a first signal generator configured to generate a first power control signal using a first reference voltage and at least one of the feedback control signals; and a second signal generator configured to generate a second power control signal using a second reference voltage and at least one of the feedback control signals.

The first signal generator may include: a first node configured to receive a fixed power; a signal converter configured to change the voltage of the fixed power according to the voltage level of at least one of the feedback control signals; and a first signal output unit configured to output the first power control signal by comparing the voltage of the fixed power with the first reference voltage.

The voltage level of the first power control signal may be changed if the voltage of the fixed power is lower than the first reference voltage.

The signal converter may include a plurality of LEDs each having a cathode connected to the corresponding feedback control signal input terminal and an anode connected to the first node.

The first signal output unit may include: an amplifier having an inverting input terminal and a non-inverting input terminal to which the first reference voltage is applied; an input resistor connected between the inverting input terminal and the first node; a feedback resistor connected between the inverting input terminal and an output terminal of the amplifier; and an output resistor connected between the output terminal of the amplifier and the first power control signal output terminal.

The second signal generator may include: a conversion signal output unit configured to output a conversion signal according to the voltage level of at least one of the feedback control signals; and a second signal output unit configured to output the second power control signal by comparing the voltage of the conversion signal with the second reference voltage.

The voltage level of the second power control signal may be changed if the voltage of the conversion signal is higher than the second reference voltage.

The conversion signal output unit may include a plurality of LEDs each having an anode connected to the corresponding feedback control signal input terminal and a cathode connected to the conversion signal output terminal.

The second signal output unit may include: an amplifier having an inverting input terminal and a non-inverting input terminal to which the second reference voltage is applied; an input resistor connected between the inverting input terminal and the conversion signal output terminal; a feedback resistor connected between the inverting input terminal and an output terminal of the amplifier; and an output resistor connected between the output terminal of the amplifier and the second power control signal output terminal.

The converter may increase a current of the driving power according to the first power control signal, and may decrease the current of the diving power according to the second power control signal.

A plurality of the current difference controllers may be provided such that the current difference controllers receive the respective feedback control signals from the light emitting units.

In accordance with an exemplary embodiment, a method of driving a light-source module includes: providing driving power to a plurality of LED strings to emit light; detecting power provided to each of the LED strings; and changing the driving power according to the power detection results.

Detecting the power may include detecting the voltage level of the power applied to each of the LED strings.

The method may further include, after detecting the power, comparing the detected voltage level of the power with at least one reference voltage to generate a plurality of power control signals.

Changing the driving power may include changing the current amount of the driving power according to the power control signal.

The method may further include, after detecting the power: generating first and second power control signals having a first voltage level if the voltage levels of the power detected from the LED strings are within a predetermined operating range; generating the first power control signal having a second voltage level if the voltage level of the power detected from at least one of the LED strings is lower than the lower limit of the predetermined operating range; and generating the second power control signal having the second voltage level if the voltage level of the power detected from at least one of the LED strings is higher than the upper limit of the predetermined operating range.

Changing the driving power may provide a driving power identical to the previous driving power to the LED strings according to the first and second power control signals having the first voltage level, and may provide another driving power different in current amount from the previous driving power to the LED strings according to the first and second power control signals having the second voltage level.

Changing the driving power may increase the voltage level of the driving power according to the first power control signal having the second power level, and may decrease the voltage level of the driving power according to the second power control signal having the second power level.

In accordance with an exemplary embodiment, a display device includes: a display panel; a controller configured to control an operation of the display panel; a plurality of light emitting units connected in parallel between a driving power input terminal and a ground terminal to emit light using the driving power and to output respective feedback control signals; a current difference controller configured to output a plurality of power control signals according to the respective feedback control signals; and a converter configured to change a current of the driving power provided to the light emitting units according to the power control signals.

The current difference controller may output a plurality of power control signals having a first voltage level if the voltage levels of the feedback control signals are within a predetermined operating range, and may output a plurality of power control signals having a second voltage level if the voltage level of at least one of the feedback control signals is out of the predetermined operating range.

BRIEF DESCRIPTION OF THE DRAWINGS

Exemplary embodiments of the present invention will be understood in more detail from the following descriptions taken in conjunction with the accompanying drawings, in which.

DETAILED DESCRIPTION OF EXEMPLARY EMBODIMENTS

Hereinafter, exemplary embodiments will be described in detail with reference to the accompanying drawings. The present invention may, however, be embodied in different forms and should not be construed as limited to the exemplary embodiments set forth herein. Rather, these exemplary embodiments are provided so that this disclosure will be thorough and complete, and will fully convey the scope of the present invention to those of ordinary skill in the art.

Figure 1:
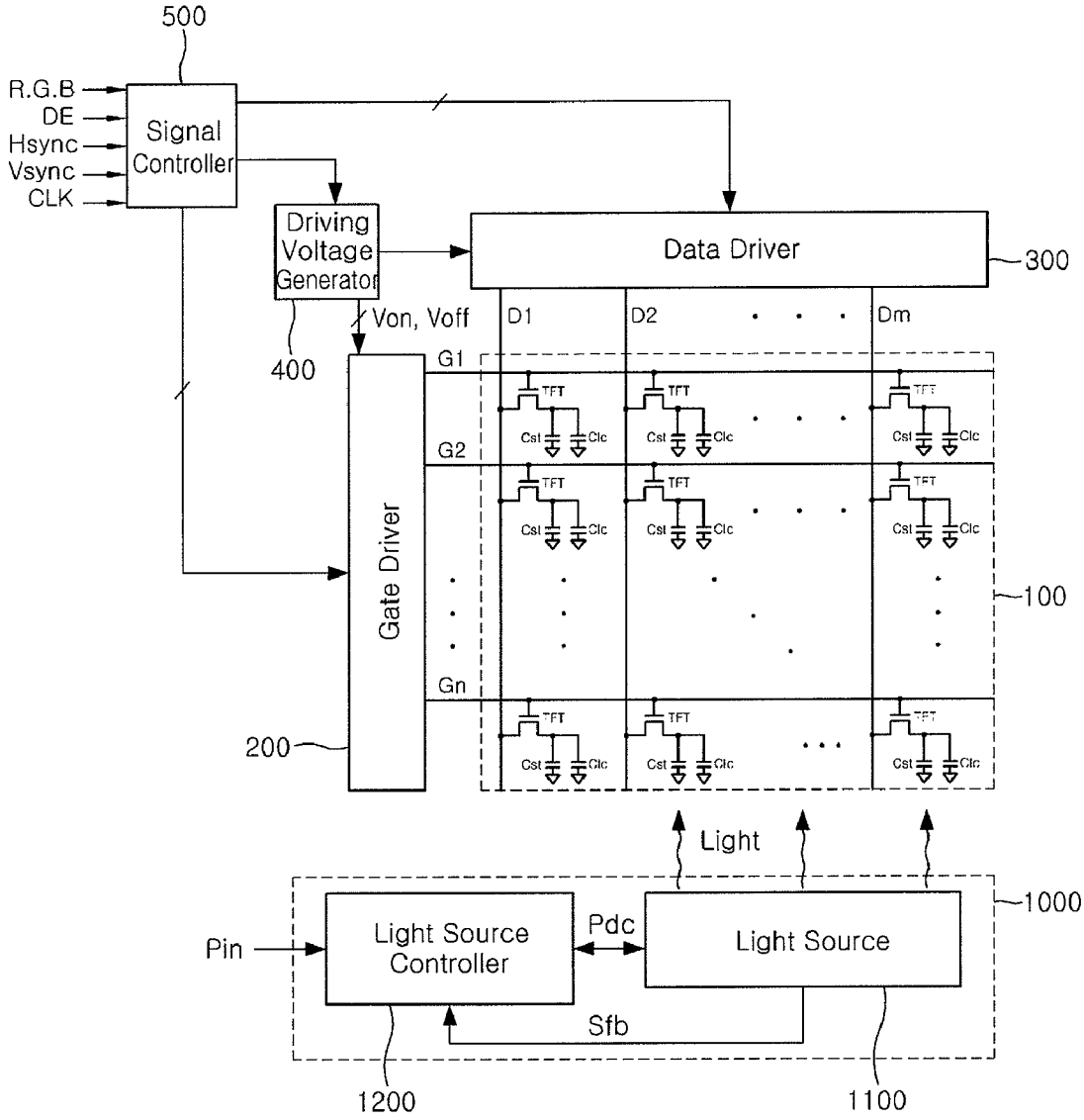
FIG. 1 is a block diagram of a display device in accordance with an exemplary embodiment.
Figure 2:
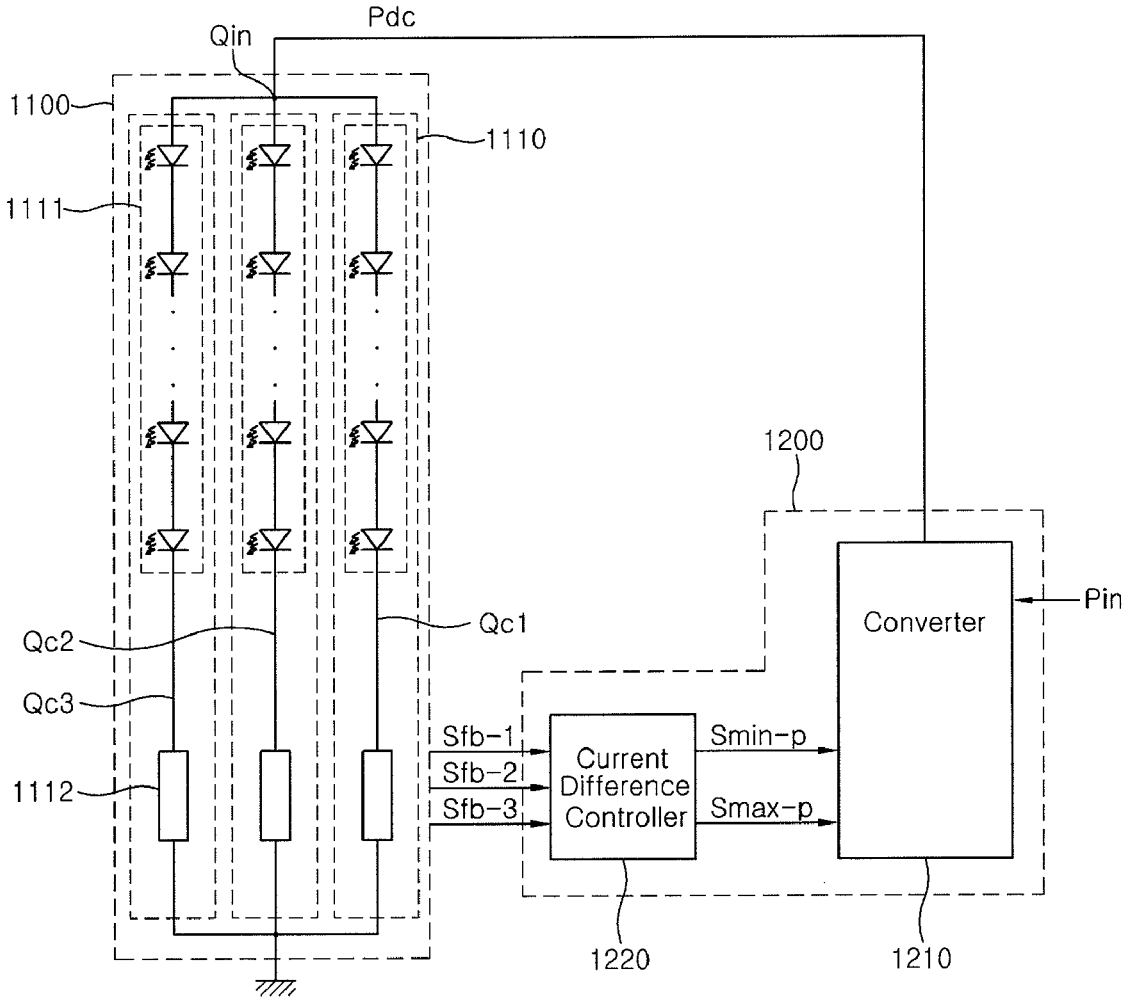
FIG. 2 is a block diagram of a light source module in accordance with the exemplary embodiment.
Figure 3:
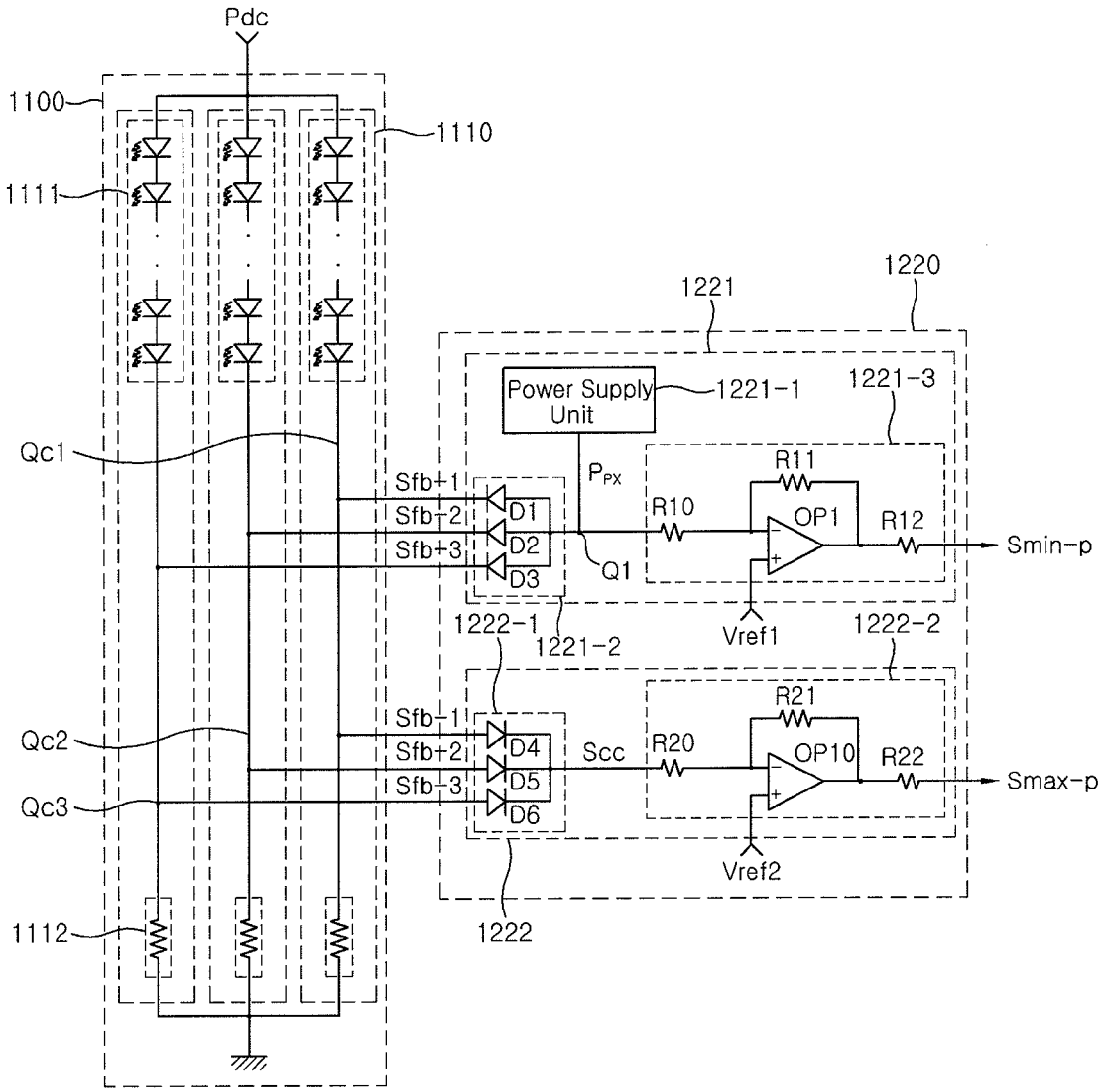
FIG. 3 is a circuit diagram of a current difference controller in accordance with the exemplary embodiment.
Figure 4:
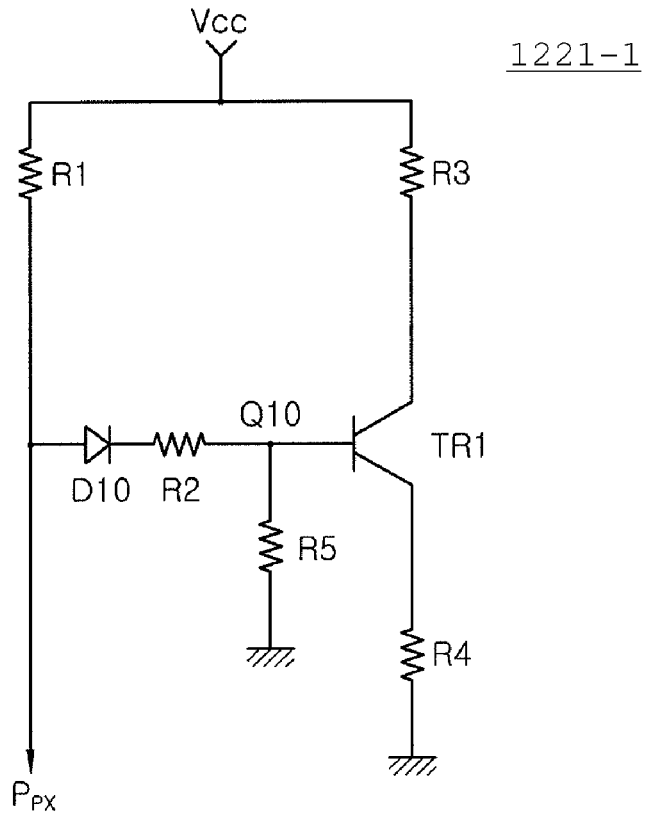
FIG. 4 is a circuit diagram of a power supply unit in accordance with the exemplary embodiment.
Figure 5:
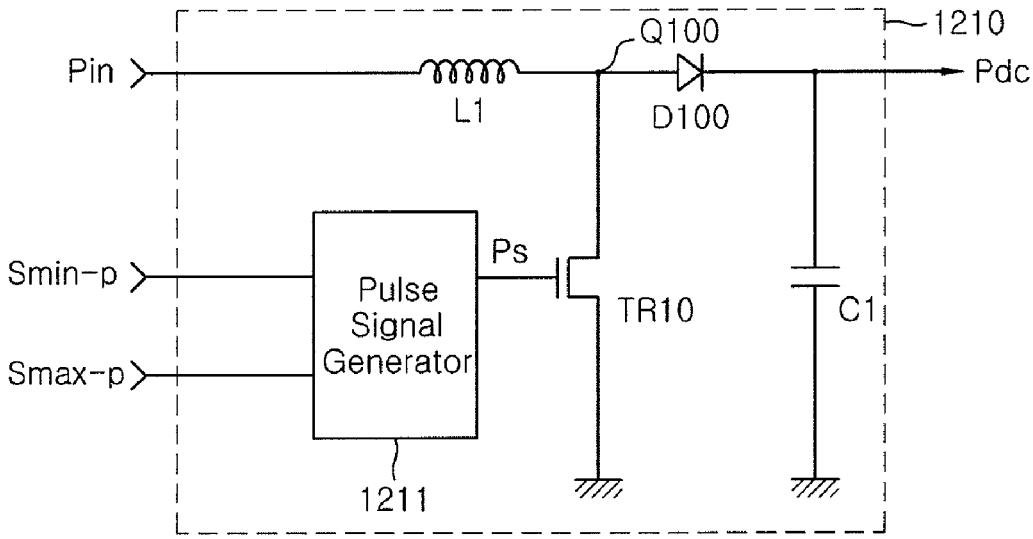
FIG. 5 is a circuit diagram of a converter in accordance with the exemplary embodiment.
Figure 6:
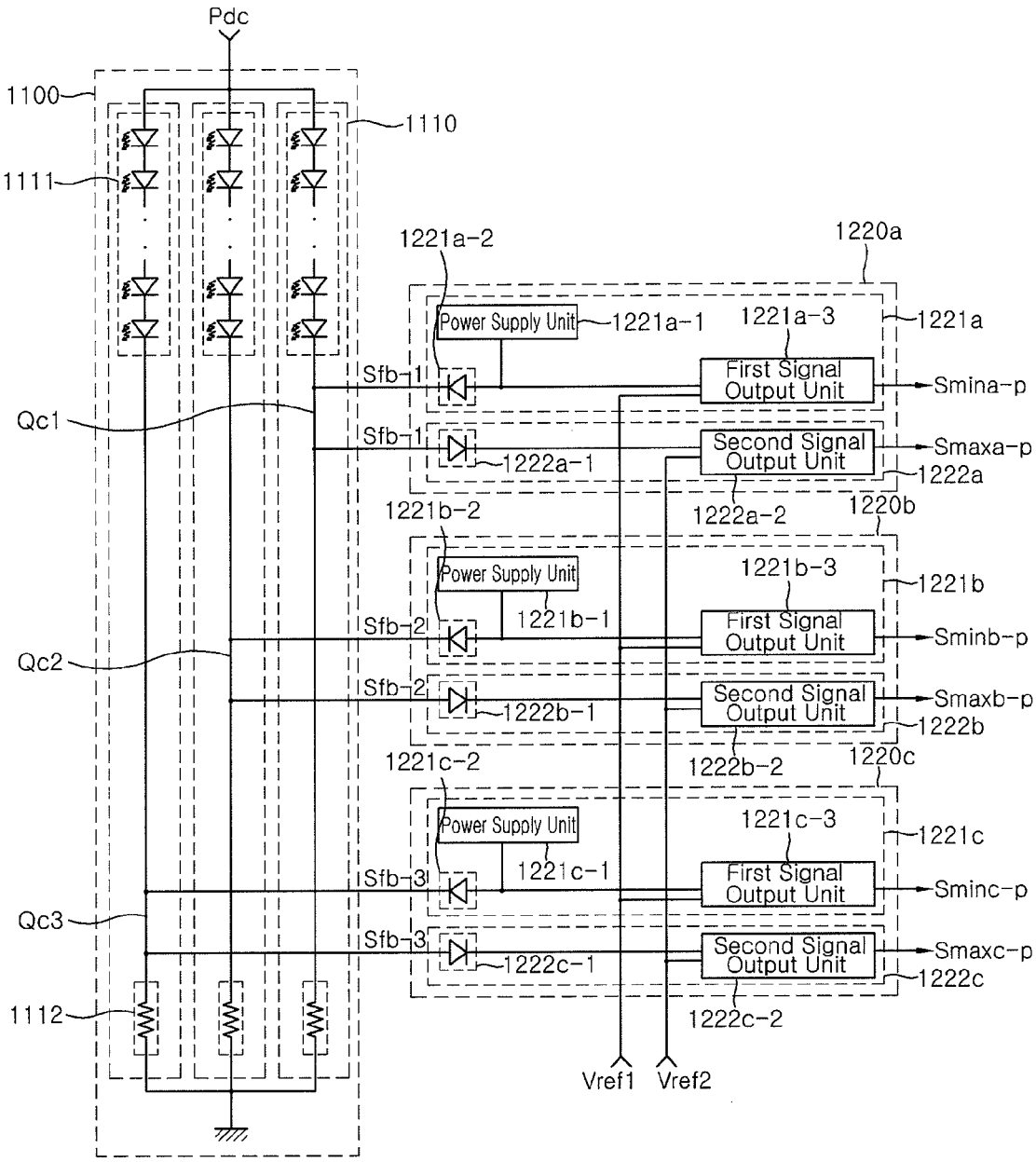
FIG. 6 is a circuit diagram of a current difference controller in accordance with an exemplary embodiment.

FIG. 1 is a block diagram of a display device in accordance with an exemplary embodiment of the present invention. FIG. 2 is a block diagram of a light source module used in the exemplary embodiment shown in FIG. 1. FIG. 3 is a circuit diagram of a current difference controller used in the exemplary embodiment shown in FIG. 2. FIG. 4 is a circuit diagram of a power supply unit in accordance with an exemplary embodiment. FIG. 5 is a circuit diagram of a converter used in the exemplary embodiment shown in FIG. 2. FIG. 6 is a circuit diagram of a current difference controller in accordance with an exemplary embodiment of the present invention.

Referring to FIGS. 1 to 5, a display device in accordance with an exemplary embodiment includes a display panel 100, a gate driver 200, a data driver 300, a driving voltage generator 400, a signal controller 500, and a light-source module 1000.

The display panel 100 is driven according to the operations of the gate driver 200 and the data driver 300, and displays an image using light from the light source module 1000. As illustrated in FIG. 1, the display panel 100 includes a plurality of gate lines G1 to Gn, a plurality of data lines D1 to Dm, and a plurality of unit pixels. The plurality of gate lines G1 to Gn extends in one direction, and the plurality of data lines D1 to Dm extends in another direction intersecting the gate lines G1 through Gn. At least one end of each of the gate lines G1 to Gn is connected to the gate driver 200, and at least one end of each of the data lines D1 to Dm is connected to the data driver 300.

As illustrated in FIG. 1, each of the unit pixels includes a thin film transistor TFT, a storage capacitor Cst, and a liquid crystal capacitor Clc. The liquid crystal capacitor Clc includes a lower pixel electrode, an upper common electrode, with a liquid crystal interposed between the pixel electrode and the common electrode. Although not illustrated in FIG. 1, a color filter is disposed on the liquid crystal capacitor Clc. The pixel electrode and the common electrode may be divided into a plurality of domains. It will be readily understood by those of ordinary skill in the art that various modifications and changes can be made to the display panel 100. For example, a plurality of pixels may be provided in a unit pixel region. Also, the unit pixel region may be longer or shorter in the longitudinal direction than in the lateral direction. Also, the unit pixel region may have various shapes, as well as a generally square shape.

Controllers providing signals for driving the display panel 100 are disposed outside the display panel 100. The controllers include the gate driver 200, the data driver 300, the driving voltage generator 400, and the signal controller 500.

In normal operation, the signal controller 500 receives an input image signal and an input control signal from an external graphic controller (not illustrated). The input image signal includes pixel data R, G, and B. The input control signal is used to control the display of an image display signal. The input control signal includes a vertical sync signal Vsync, a horizontal sync signal Hsync, a main clock CLK, and a data enable signal DE. The signal controller 500 processes pixel data according to the operating conditions of the display panel 100. By doing so, the pixel data are rearranged according to the pixel arrangement of the display panel 100. Also, the signal controller 500 generates gate control signals and data control signals and transfers the gate control signals and the data control signals respectively to the gate driver 200 and the data driver 300. The gate control signals include an output enable signal indicating the start of the output of a gate turn-on voltage Von, a gate clock signal, and a vertical sync start signal. The data control signal includes a data clock signal, an inverting signal inverting the polarity of a gradation voltage with respect to a common voltage, a load signal for applying a data voltage on the corresponding data line, and a sync start signal indicating the start of transfer of pixel data.

The driving voltage generator 400 generates a variety of driving voltages for the display device using external power received from an external power supply (not shown). The driving voltage generator 400 generates a reference voltage, a gate turn-on voltage Von, a gate turn-off voltage Voff, and a common voltage. According to the control signal from the signal controller 500, the driving voltage generator 400 applies the gate turn-on voltage Von and the gate turn-off voltage Voff to the gate driver 200 and applies the reference voltage to the data driver 300. The reference voltage is used to generate a gradation voltage for driving the liquid crystal in the display panel 100.

The gate driver 200 is connected to the plurality of gate lines G1 to Gn. According to a control signal from the signal controller 500, the gate driver 200 provides the gate turn-on voltage Von of the driving voltage generator 400 to the gate lines G1 to Gn sequentially. In this way, operation of each thin film transistor TFT can be controlled.

The data driver 300 is connected to the plurality of data lines D1 to Dm. The data driver 300 generates a gradation voltage using a control signal from the signal controller 500 and a reference voltage GVDD from the driving voltage generator 400. Also, the data driver 300 applies a corresponding gradation voltage to each of the data lines D1 to Dm. That is, the data driver 300 converts input digital pixel data into an analog data signal, that is, a gradation voltage, and outputs the resulting signal.

The signal controller 500, the driving voltage generator 400, the data driver 300, and the gate driver 200 are fabricated in integrated circuit (IC) chips and are mounted on a printed circuit board (PCB) (not shown). The PCB is electrically connected through a flexible printed circuit board (FPCB) (not shown) to the display panel 100. The display panel 100 includes an upper substrate and a lower substrate that are not shown in FIG. 1. The substrates may be glass substrates or transparent plastic substrates. The gate driver 200 and the data driver 300 may be mounted on the transparent substrate of the display panel 100. Also, the gate driver 200 may be formed in a process stage on the lower substrate of the display panel 100. That is, the gate driver 200 may be formed simultaneously with the formation of the thin film transistors TFT on the lower substrate.

As illustrated in FIG. 1, the light-source module 1000 includes a light source 1100 and a light-source controller 1200. The light source 1100 provides light to the display panel 100, and the light-source controller 1200 controls an operation of the light source 1100. The light source 1100 provides a feedback control signal Sfb fed back to the light source controller 1200. The operation of the light-source controller 1200 is controlled according to the feedback control signal Sfb.

The light source 1100 includes a plurality of light emitting units 1110 shown in FIG. 2. The plurality of light emitting units 1110 are connected in parallel between an input terminal Qin and a ground terminal. Referring to FIG. 2, the light source 1100 includes three light emitting units 1110 that are connected in parallel. The number of light emitting units 1110 in a light source is not limited thereto, however, and may be variable.

Each of the light emitting units 1110 includes an LED string 1111 and a power detector 1112 that are connected in series.

As illustrated in FIG. 2, the LED string 1111 includes a plurality of LEDs connected in series. Alternatively, the LEDs of the LED string may be connected in parallel and/or anti-parallel. The number of LEDs in each of the LED strings 1111 in the light emitting units 1110 may be the same. Although not illustrated, the light emitting unit 1110 may include a substrate where a plurality of LEDs are mounted, and a power supply terminal supplying the power for the LEDs. The substrate may be formed in a bar shape or in a plate shape. When the substrate is formed in a bar shape, the LEDs are arranged in a line configuration. When the substrate is formed in a plate shape, the LEDs are arranged in a matrix configuration. Each of the light emitting units 1110 emits light as a separate channel.

The plurality of light emitting units 1110 have control nodes Qc1, Qc2, and Qc3, respectively. That is, in this exemplary embodiment, the light source 1100 has three light emitting units 1110. Accordingly, the light source 1100 has three control nodes Qc1, Qc2, and Qc3.

The LED string 1111 is connected between the input terminal Qin and the control nodes Qc1, Qc2, and Qc3. The power detectors 1112 are connected between the ground terminal and the control nodes Qc1, Qc2, and Qc3. The LED string 1111 emits light according to the DC power applied through the input terminal Qin. The power detector 1112 detects the amount of a current flowing through the LED string 1111, and each LED string 1111 includes its own power detector 1112. As illustrated in FIG. 3, the power detector 1112 includes a resistor. Using a voltage applied across the resistor, the power detector 1112 detects the amount of current flowing through the LED string 1111. The resistance of the resistors of the power detectors 1112 in the light emitting units 1110 may be the same. According to the detected current amount, that is, the voltage applied across the resistor, the light emitting units 1110 generate feedback control signals Sfb-1, Sfb-2 and Sfb-3, respectively, as shown in FIG. 3. The feedback control signals Sfb-1, Sfb-2, and Sfb-3 have the same power level as the control nodes Qc1, Qc2, and Qc3, respectively.

The light source controller 1200 operates according to external DC power Pin and the feedback control signal Sfb-1, Sfb-2, and Sfb-3 to provide driving power Pdc to the light source 1100.

As illustrated in FIG. 2, the light source controller 1200 includes a current difference controller 1220 and a converter 1210. The current difference controller 1220 receives the feedback control signals Sfb-1, Sfb-2, and Sfb-3 and outputs a plurality of power control signals Smin-p and Smax-p. The converter 1210 outputs the driving power Pdc according to the external power Pin and the power control signals Smin-p and Smax-p.

The current difference controller 1220 outputs the plurality of power control signals Smin-p and Smax-p according to the feedback control signals Sfb-1, Sfb-2, and Sfb-3, that is, the voltages of the control nodes Qc1, Qc2, and Qc3 in the plurality of light emitting units 1110. The plurality of power control signals include a first power control signal Smin-p and a second power control signal Smax-p. The level of the first power control signal Smin-p is changed if the voltages of the feedback control signals Sfb-1, Sfb-2, and Sfb-3 that is, the voltages of the control nodes Qc1, Qc2, and Qc3, are lower than a first reference voltage Vref1. Likewise, the level of the second power control signal Smax-p is changed if the voltages of the feedback control signals Sfb-1, Sfb-2, and Sfb-3 that is, the voltages of the control nodes Qc1, Qc2, and Qc3, are lower than a second reference voltage Vref2.

As illustrated in FIG. 3, the current difference controller 1220 includes a first signal generator 1221 and a second signal generator 1222. The first signal generator 1221 generates the first power control signal Smin-p according to the first reference voltage Vref1 and the feedback control signals Sfb-1, Sfb-2, and Sfb-3. Similarly, the second signal generator 1222 generates the second power control signal Smax-p according to the second reference voltage Vref2 and the feedback control signals Sfb-1, Sfb-2, and Sbf-3.

If the voltage levels of the feedback control signals Stb-1, Sfb-2, and Sbf-3 are lower than the lower limit of a predetermined operating range, the current difference controller 1220 outputs the first power control signal Smin-p using the first signal generator 1221. On the other hand, if the voltage levels of the feedback control signals Sfb-1, Sfb-2, and Sbf-3 are higher than the upper limit of the predetermined operating range, the current difference controller 1220 outputs the second power control signal Smax-p using the second signal generator 1222. In an example, it is assumed that the predetermined operating range is from 0.3 V to 0.6 V. If the voltage levels of the feedback control signals. Sfb-1, Sfb-2, and Sfb-3 are lower than 0.3 V, the current difference controller 1220 provides the first power control signal Smin-p to the converter 1210. According to the first power control signal Smin-p, the converter 1210 increases the voltage level of the driving power. On the other hand, if the voltage level of the feedback control signal Sfb-1 to Sfb-3 is higher than 0.6 V, the current difference controller 1220 provides the second power control signal Smax-p to the converter 1210. According to the second power control signal Smax-p, the converter 1210 decreases the voltage level of the driving power. The predetermined operating range may be selected to be any range within the voltage range of the driving power supplied to drive the light source 1100. The brightness uniformity of the light source 1100 increases as the width of the predetermined operating range decreases.

The construction and operation of the current difference controller 1220 will be described in more detail with reference to FIG. 3.

The first signal generator 1221 includes a first node Q1, a power supply unit 1221-1, a signal converter 1221-2, and a first signal output unit 1221-3. The power supply unit 1221-1 supplies a fixed power Ppx to the first node Q1. The signal converter 1221-2 changes the power level of the first node Q1 according to a state of the feedback control signals Sfb-1, Sfb-2, and Sfb-3. The first signal output unit 1221-3 compares the power level of the first node Q1 with the first reference voltage Vref1 to generate the first power control signal Smin-p.

If the voltage level of at least one of the feedback control signals Sfb-1, Sfb-2, and Sfb-3 is lower than the lower limit of the predetermined operating range, the signal converter 1221-2 changes the voltage level of the fixed power Ppx supplied to the first node Q1. The signal converter 1221-2 includes a plurality of diodes D1, D2, and D3. Each diode D1/D2/D3 has a cathode connected respectively to the feedback control signals Sfb-1/Sfb-2/Sfb-3 and an anode connected to the first node Q1.

If the voltage of at least one of the feedback control signals Sfb-1, Sfb-2, and Sfb-3 is lower than the voltage of the first node Q1, the signal converter 1221-2 forms a current path between the first node Q1 and at least one of the control nodes Qc1, Qc2, and Qc3, thereby changing the voltage level of the first node Q1.

The current path is formed when the voltage of the first node Q1 subtracted by at least one signal voltage of the feedback control signals Sfb-1, Sfb-2, and Sfb-3 is larger than the threshold voltage of the diodes D1, D2, and D3. Thus, it is preferable that the voltage level of the fixed power Ppx from the power supply unit 1221-1 is the sum of the threshold voltage of the diodes D1, D2, and D3 and the voltage level corresponding to the lower limit of the predetermined operating range. For example, if the predetermined operating range is from 0.3 V to 0.6 V and if the threshold voltage of the diodes D1, D2, and D3 is 0.7 V, it is preferable that the voltage level of the fixed power Ppx is 1 V. In this exemplary embodiment, the current path is formed when the voltage of at least one of the feedback control signals Sfb-1, Sfb-2, and Sfb-3 is 0.2 V.

The signal converter 1221-2 may be constructed using any circuit that increases the voltage level of the first node Q1 according to the voltage levels of the feedback control signals Stb-1, Stb-2, and Sfb-3.

The power supply unit 1221-1 supplies the fixed power Ppx with a predetermined voltage level independently of external influences. For example, as illustrated in FIG. 4, the power supply unit 1221-1 includes a first resistor R1, a tenth diode D10, a second resistor R2, a third resistor R3, a transistor TR1, a fourth resistor R4, and a fifth resistor R5. The first resistor R1 is connected between an external power Vcc and an output terminal of the fixed power Ppx. The tenth diode D10 and the second resistor R2 are connected in series between the output terminal of the fixed power Ppx and a tenth node Q10. The third resistor R3 is connected to the external power Vcc. The transistor TR1 has a gate connected to the tenth node Q10, and a source connected to the third resistor R3. The fourth resistor R4 is connected to a ground terminal and a drain of the transistor TR1. The fifth resistor R5 is connected between the tenth node Q10 and a ground terminal. The voltage of the fixed power Ppx may be determined depending on the threshold voltage of the diodes D1, D2, and D3 of the signal converter 1221-2 shown in FIG. 3.

The first signal output unit 1221-3 compares the voltage of the first node Q1, for example, the voltage of the fixed power Ppx with the first reference voltage Vref1 to generate the first power control signal Smin-p. The first signal output unit 1221-3 includes an amplifier OP1, a tenth resistor R10, an eleventh resistor R11, and a twelfth resistor R12. The amplifier OP1 has an inverting input terminal (−) and a non-inverting input terminal (+) receiving the first reference voltage Vref1. The tenth resistor R10 is connected between the first node Q1 and the inverting input terminal (−). The eleventh resistor R11 is connected to the inverting input terminal (−) and an output terminal of the amplifier OP1. The twelfth resistor R12 is connected between the output terminal of the amplifier OP1 and an output terminal of the first power control signal Smin-p.

The first signal output unit 1221-3 generates the first power control signal Smin-p that has various voltage levels depending on the difference between the first reference voltage Vref1 and the voltage of the first node Q1. The first reference voltage Vref1 is constant, whereas the voltage of the first node Q1 changes according to the voltages of the feedback control signals Sfb-1, Sfb-2, and Sfb-3, as described above. Thus, if the first node Q1 maintains the voltage of the fixed power Ppx, the first signal output unit 1221-3 outputs the first power control signal Smin-p with a first voltage level. On the other hand, if the first node Q1 fails to maintain the voltage of the fixed power Ppx, the first signal output unit 1221-3 outputs the first power control signal Smin-p with a second voltage level. The first power control signal Smin-p with the first or second voltage level is provided to the converter 1210 shown in FIG. 2. If the first power control signal Smin-p with the first voltage level is provided to the converter 1210, the converter 1210 performs a normal operation. On the other hand, if the first power control signal Smin-p with the second voltage level is provided to the converter 1210, the converter 1210 increases the level of the driving power and provides the resulting increased power to the light source 1100 as driving power Pdc as shown in FIG. 2. In this exemplary embodiment, it is preferable that the fixed power Ppx and the first reference voltage Vref1 have the same voltage level.

The second signal generator 1222 includes a conversion signal output unit 1222-1 and a second signal output unit 1222-2. The conversion signal output unit 1222-1 outputs a conversion signal Scc according to a state of the feedback control signals Sfb-1, Sfb-2, and Sfb-3. The second signal output unit 1222-2 compares the conversion signal Scc with the second reference voltage Vref2 in an amplifier OP10 to generate the second power control signal Smax-p.

The conversion signal output unit 1222-1 outputs the conversion signal Scc when the voltage level of at least one of the feedback control signals Sfb-1, Sfb-2, and Sfb-3 is higher than the upper limit of the predetermined operating range. The conversion signal output unit 1222-1 includes a plurality of diodes D4, D5, and D6. Each diode D4/D5/D6 has an anode respectively connected to the feedback control signal Sfb-1/Sfb-2/Sfb-3 and a cathode connected to an output terminal of the conversion signal output unit 1222-1. Thus, when the voltage of at least one of the feedback control signals Sfb-1, Sfb-2, and Sfb-3 is higher than the threshold voltage of the diodes D4, D5, and D6, the conversion signal output unit 1222-1 outputs the feedback control signal Sfb-1, Sfb-2, and Sfb-3 as the conversion signal Scc. On the other hand, if the voltage of the feedback control signals Sfb-1, Sfb-2, and Sfb-3 is lower than the threshold voltage of the diodes D4, D5, and D6, the conversion signal output unit 1222-1 does not output the conversion signal Scc.

Accordingly, the threshold voltage may be adjusted to generate the conversion signal Scc when the voltage of at least one of the feedback control signals Sfb-1, Sfb-2, and Sfb-3 is higher than the upper limit of the predetermined operating range. In an example it is assumed that the predetermined operating range is from 0.3 V to 0.7 V and that the threshold voltage of the diodes D4, D5, and D6 is 0.7 V. In this exemplary embodiment, when a voltage of 0.9 V is applied as the voltage of at least one of the feedback control signals Sfb-1, Sfb-2, and Sfb-3, the diodes D4, D5, and D6 supplied with the 0.9-V feedback control signal outputs the conversion signal Scc with a voltage level of about 0.9 V.

The second signal output unit 1222-2 compares the conversion signal Scc with the second reference voltage Vref2 to generate the second power control signal Smax-p.

The second signal output unit 1222-2 includes the amplifier OP10, a $20^{th}$ resistor R20, a $21^{st}$ resistor R21, and a $22^{nd}$ resistor R2. The amplifier OP10 has an inverting input terminal (−) and a non-inverting input terminal (+) receiving the second reference voltage Vref2. The 20th resistor R20 is connected between the inverting input terminal (−) and an input terminal of the conversion signal Scc. The $21^{st}$ resistor R21 is connected to the inverting input terminal (−) and an output terminal of the amplifier OP10. The $22^{nd}$ resistor R22 is connected between the output terminal of the amplifier OP10 and an output terminal of the second power control signal Smax-p.

The second signal output unit 1222-2 generates the second power control signal Smax-p that has various voltage levels depending on the difference between the second reference voltage Vref2 and the voltage of the conversion signal Scc. The second reference voltage Vref2 is constant, whereas the voltage of the conversion signal Scc changes according to the voltages of the feedback control signals Sfb-1, Sfb-2, and Sfb-3 as described above. Thus, when the voltage of the conversion signal Scc is lower than the second reference voltage Vref2, the second signal output unit 1222-2 outputs the second power control signal Smax-p with a first voltage level. Of course, if the voltage of the feedback control signals Sfb-1, Sfb-2, and Sfb-3 is lower than the threshold voltage of the diodes D4, D5, and D6, the conversion signal Scc is not output. On the other hand, when the voltage of the conversion signal Scc is higher than the second reference voltage Vref2, the second signal output unit 1222-2 outputs the second power control signal Smax-p with a second voltage level.

The second power control signal Smax-p with the first or second voltage level is provided to the converter 1210 shown in FIG. 2. If the second power control signal Smax-p with the first voltage level is provided to the converter 1210, the converter 1210 performs a normal operation. On the other hand, if the second power control signal Smax-p with the second voltage level is provided to the converter 1210, the converter 1210 decreases the level of the driving power and provides the resulting power to the light source 1100 shown in FIG. 2 as driving power Pdc.

As described above, the current difference controller 1220 outputs the first power control signal Smin-p with the second voltage level when the voltage of the control node of each light emitting unit, that is, the voltage of at least one of the feedback control signals Stb-1, Stb-2, and Sfb-3, is lower than the predetermined operating range. Meanwhile, the current difference controller 1220 outputs the second power control signal Smax-p with the second voltage level when the voltage of the control node of each light emitting unit is higher than the predetermined operating range.

The converter 1210 converts the external DC power Pin into the driving power Pdc. The voltage level of the driving power Pdc changes according to the first and second power control signals Smin-p and Smax-p. That is as described above, the converter 1210 provides new driving power Pdc, which has a higher voltage level than the previous driving power Pdc, when the first power control signal Smin-p of the second voltage level is provided. Also, the converter 1210 provides new driving power Pdc, which has a lower voltage level than the previous driving power Pdc, when the second power control signal Smax-p of the second voltage level is provided.

In this exemplary embodiment, a DC-DC converter is used as the converter 1210. That is, the converter 1210 increases the voltage of the external DC power Pin and outputs the resulting power as the driving power Pdc. As illustrated in FIG. 5, the converter 1210 includes a pulse signal generator 1211, an inductor L1, a tenth transistor TR10, a rectifying diode D100, and a capacitor C1. The pulse signal generator 1211 generates a pulse signal Ps according to the first and second power control signals Smin-p and Smax-p. The inductor L1 is connected between a node Q100 and an input terminal of the external DC power Pin. The tenth transistor TR10 is connected between the node Q100 and the ground terminal and operates according to the pulse signal Ps. The rectifying diode D100 is connected between the node Q100 and an output terminal of the driving power Pdc. The capacitor C1 is connected between the ground terminal and the output terminal of the driving power Pdc. Of course, in an exemplary embodiment, the converter 1210 may also control the driving power Pdc using a current fed back from the light source 1100.

The pulse signal generator 1211 generates a square-wave pulse signal Ps. In this exemplary embodiment, the pulse signal generator 1211 is provided with a separate power voltage (not shown) and an external control signal (not shown). The pulse signal generator 1211 adjusts a duty ratio of the square-wave pulse signal Ps so that the converter 1210 outputs a constant DC voltage, that is, the driving power Pdc. The pulse signal generator 1211 adjusts the duty ratio of the square-wave pulse signal Ps according the first and second power control signals Smin-p and Smax-p. When the tenth transistor TR10 is tuned on by the pulse signal Ps, a current path is formed between the input DC power and the ground terminal. Accordingly, the amount of current flowing through the inductor L1 increases with time. The input power Pin flows into the inductor L1 and, thus, energy is stored in the inductor L1. Thereafter, when the tenth transistor TR10 is turned off by the pulse signal Ps, the current path between the input DC power and the ground terminal is interrupted and the current flowing through the inductor L1 is interrupted. Accordingly, a high voltage is generated in the inductor L1 due to a high-energy counter electromotive force. The generated high voltage turns on the rectifying diode D100 and allows a current, which is stored as a magnetic field in the inductor L1, to flow through the rectifying diode D100, thereby charging the capacitor C1 with an electric charge. The resulting voltage of the capacitor C1 is used as the driving power Pdc supplied to the light source 1100.

A description will now be given of an operation of the light-source module 1000 having the above-described construction.

According to the external power Pin and the first and second control signals Smin-p and Smax-p, the converter 1210 provides the driving power Pdc to the light source 1100. The driving power Pdc is provided to the light emitting units 1110 that are connected in parallel between the input and output terminals of the light source 1100. Accordingly, the LED strings 1111 of the light emitting units 1110 emit light according to the driving power Pdc. Also, the control nodes Qc1, Qc2, and Qc3 of the light emitting units 1110 have a voltage of a predetermined level according to the power detector 1112.

The light-source controller 1200 changes the current level of the driving power Pdc so that the voltages of the control nodes Qc1, Qc2, and Qc3 are within the predetermined operating range. If the voltages of the control nodes Qc1, Qc2, and Qc3 are within the predetermined operating range, the converter 1210 provides the light source 1100 with the driving power Pdc having the first voltage level. When at least one of the voltages of the control nodes Qc1, Qc2, and Qc3 is lower than the lower limit of the predetermined operating range, the converter 1210 uses the first signal generator 1221 to provide the light source 1100 with the driving power Pdc that has a voltage level higher than the first voltage level. When at least one of the voltages of the control nodes Qc1, Qc2, and Qc3 is higher than the upper limit of the predetermined operating range, the converter 1210 uses the first signal generator 1221 to provide the light source 1100 with the driving power Pdc that has a voltage level lower than the first voltage level. Herein, the amount of current flowing through each of the light emitting units 1110 is different depending on the voltage range of the control nodes Qc1 to Qc3. Therefore, the brightness uniformity of the light emitting units 1110 can be maintained by increasing or decreasing the amount of the driving power Pdc depending on the voltages of the control nodes Qc1, Qc2, and Qc3, as described above. That is, if at least one of the light emitting units is high in brightness, the overall brightness is increased to increase the average brightness; and if at least one of the light emitting units is low in brightness, the overall brightness is decreased to decrease the average brightness. Alternatively, if at least one of the light emitting units is high in brightness, the overall brightness is decreased to decrease the average brightness; and if at least one of the light emitting units is low in brightness, the overall brightness is increased to increase the average brightness.

It will be readily understood by those of ordinary skill in the all that various modifications and changes can be made to the light source module 1000 shown in FIG. 1. That is, as illustrated in FIG. 6, the light source module may include a plurality of current difference controllers that operate according to the voltage levels of the control nodes Qc1, Qc2, and Qc3 of the respective light emitting units in order to adjust the brightness of each light emitting unit separately.

That is, as illustrated in FIG. 6, when the light source 1100 includes three light-emitting units 1110, the light source controller, 1200 in FIG. 2, includes three current difference controllers 1220*a*, 1220*b*, and 1220*c*. Each first/second/third current difference controller 1220*a*/1220*b*/1220*c* includes a first signal generator 1221*a*1/1221*b*/1221*c* receiving the first reference voltage Vref1 and a second signal generator 1222*a*/1222*b*/1222*c* receiving the second reference voltage Vref2. The first signal generator 1221*a*1/1221*b*/1221*c* includes a power supply unit 1221*a*-1/1221*b*-1/1221*c*-1, a signal converter 1221*a*-2/1221*b*-2/1221*c*-2, and a first signal output unit 1221*a*-3/1221*b*-3/1221*c*-3. The second signal generator 1222*a*/1222*b*/1222*c* includes a conversion signal output unit 1222*a*-1/1222*b*-1/1222*c*-1 and a second signal output unit 1222*a*-2/1222*b*-2/1222*c*-2.

The first current difference controller 1220*a* is connected to the control node Qc1 of the first light emitting unit 1110, that is, the first feedback control signal Sfb-1, to generate the first and second power control signals Smina-p and Smaxa-p. The second current difference controller 1220*b* is connected to the control node Qc2 of the second light emitting unit 1110 to generate the first and second power control signals Sminb-p and Smaxb-p. The third current difference controller 1220*c* is connected to the control node Qc3 of the third light emitting unit 1110 to generate the first and second power control signals Sminc-p and Smaxc-p. The first power control signals Smina-p, Sminb-p, and Sminc-p and the second power control signals Smaxa-p, Smaxb-p, and Smaxc-p are provided to the converter 1210, as shown in FIG. 2. The converter 1210 controls the level of the driving power according to the above-described power control signals. Alternatively, the light emitting units may be driven by three different converters 1210. That is, when the light source 1100 includes three light-emitting units 1110, three separate converters 1210 can provide the driving power respectively to the three light emitting units. In such an exemplary embodiment, the first and second power control signals Smina-p and Smaxa-p are applied to the first converter to control the brightness of the first light emitting unit. The first and second power control signals Sminb-p and Smaxb-p are applied to the second converter to control the brightness of the second light emitting unit. The first and second power control signals Sminc-p and Smaxc-p are applied to the third converter to control the brightness of the third light emitting unit. In this way, the brightness of the light emitting units can be controlled separately.

As described above, the amounts of the currents flowing through the light emitting units each having a plurality of LEDs are measured, and the levels of voltages applied to the light emitting units are changed according to the measurement results. Accordingly, a current difference between the light emitting units can be reduced and the brightness uniformity of the light source can be improved. In addition, the amounts of the currents flowing through the light emitting units can be controlled separately.

Although the light-source module for a display device and the display device having the same have been described with reference to the exemplary embodiments, they are not limited thereto. Therefore, it will be readily understood by those of ordinary skill in the art that various modifications and changes can be made thereto without departing from the spirit and scope of the present invention, as defined by the appended claims.

What is claimed is:

1. A light-source module comprising:

a plurality of light-emitting units connected in parallel between a driving power input terminal and a ground terminal to emit light by the driving power and to output a respective plurality of feedback control signals;

a current difference controller configured to output a plurality of power control signals according to the plurality of feedback control signals; and a converter configured to change a current of the driving power provided to the plurality of light-emitting units according to the plurality of power control signals, wherein the current difference controller outputs the plurality of power control signals having a first voltage level when the voltage levels of the plurality of feedback control signals are within a predetermined operating range, and outputs the plurality of power control signals having a second voltage level when the voltage level of at least one of the plurality of feedback control signals is out of the predetermined operating range.

2. The light-source module of claim 1, wherein each of the plurality of light-emitting units comprises:

a control node configured to output the feedback control signal;

a light emitting diode (LED) string comprising a plurality of LEDs and connected between the driving power input terminal and the control node; and a power detector connected between the control node and the ground terminal.

3. The light-source module of claim 1, wherein the current difference controller outputs a first power control signal having the second voltage level when the voltage level of at least one of the feedback control signals is lower than a lower limit of the predetermined operating range, and outputs a second power control signal having the second voltage level when the voltage level of at least one of the feedback control signals is higher than an upper limit of the predetermined operating range.

4. The light-source module of claim 3, wherein the converter increases a voltage level of the driving power according to the first power control signal having the second voltage level, and decreases the voltage level of the driving power according to the second power control signal having the second voltage level.

5. The light-source module of claim 1, wherein a plurality of the current difference controllers is provided such that the plurality of current difference controllers receive the respective feedback control signals from the light emitting units.

6. A light-source module comprising:

a plurality of light-emitting units connected in parallel between a driving power input terminal and a ground terminal to emit light by the driving power and to output a respective plurality of feedback control signals;

a current difference controller configured to output a plurality of power control signals according to the plurality of feedback control signals; and a converter configured to change a current of the driving power provided to the plurality of light-emitting units according to the plurality of power control signals, wherein the current difference controller comprises:

a first signal generator configured to generate a first power control signal using a first reference voltage and at least one of the plurality of feedback control signals; and a second signal generator configured to generate a second power control signal using a second reference voltage and at least one of the plurality of feedback control signals, and wherein the first signal generator comprises:

a first node configured to receive a fixed power;

a signal converter configured to change a voltage of the fixed power according to the voltage level of at least one of the plurality of feedback control signals; and a first signal output unit configured to output the first power control signal by comparing the voltage of the fixed power with the first reference voltage.

7. The light-source module of claim 6, wherein a voltage level of the first power control signal is changed when a voltage of a fixed power is lower than the first reference voltage.

8. The light-source module of claim 6, wherein the signal converter comprises a plurality of diodes each having a cathode connected to a corresponding feedback control signal input terminal and an anode connected to the first node.

9. The light-source module of claim 6, wherein the first signal output unit comprises:

an amplifier having an inverting input terminal and a non-inverting input terminal to which the first reference voltage is applied;

an input resistor connected between the inverting input terminal and the first node;

a feedback resistor connected between the inverting input terminal and an output terminal of the amplifier; and an output resistor connected between the output terminal of the amplifier and the first power control signal output terminal.

10. The light-source module of claim 6, wherein the second signal generator comprises:

a conversion signal output unit configured to output a conversion signal according to a voltage level of at least one of the plurality of feedback control signals; and a second signal output unit configured to output the second power control signal by comparing a voltage of the conversion signal with the second reference voltage.

11. The light-source module of claim 10, wherein the conversion signal output unit comprises a plurality of diodes each having an anode connected to a corresponding feedback control signal input terminal and a cathode connected to a conversion signal output terminal.

12. The light-source module of claim 10, wherein the second signal output unit comprises:

an amplifier having an inverting input terminal and a non-inverting input terminal to which the second reference voltage is applied;

an input resistor connected between the inverting input terminal and a conversion signal output terminal;

a feedback resistor connected between the inverting input terminal and an output terminal of the amplifier; and an output resistor connected between the output terminal of the amplifier and the second power control signal output terminal.

13. The light-source module of claim 6, wherein a voltage level of the second power control signal is changed when a voltage of a conversion signal is higher than the second reference voltage.

14. The light-source module of claim 6, wherein the converter increases a current of the driving power according to the first power control signal, and decreases the current of the driving power according to the second power control signal.

15. A method of driving a light-source module, comprising:

providing driving power to a plurality of light emitting diode (LED) strings to emit light;

detecting a power provided to each of the LED strings; and changing the driving power according to the power detection results, further comprising, after detecting the power:

generating first and second power control signals having a first voltage level when the voltage levels of the power detected from the LED strings are within a predetermined operating range;

generating the first and second power control signals having a second voltage level when the voltage level of the power detected from at least one of the LED strings is out of the lower limit of the predetermined operating range.

16. The method of claim 15, wherein detecting the power comprises detecting a voltage level of the power applied to each of the LED strings.

17. The method of claim 16, further comprising, after detecting the power, comparing the detected voltage level of the power with at least one reference voltage to generate a plurality of power control signals.

18. The method of claim 17, wherein changing the driving power comprises changing a present amount of the driving power according to the plurality of power control signals.

19. The method of claim 15, wherein changing the driving power provides power identical to a previous driving power to the LED strings according to the first and second power control signals having the first voltage level, and provides another power different in amount from the previous driving power to the LED strings according to the first and second power control signals having the second voltage level.

20. The method of claim 19, wherein changing the driving power increases the voltage level of the driving power according to the first power control signal having the second power level, and decreases the voltage level of the driving power according to the second power control signal having the second power level.

21. A display device comprising:

a display panel;

a controller configured to control an operation of the display panel;

a plurality of light-emitting units connected in parallel between a driving power input terminal and a ground terminal to emit light by the driving power and to output a respective plurality of feedback control signals;

a current difference controller configured to output a plurality of power control signals according to the respective plurality of feedback control signals; and a converter configured to change a current of the driving power provided to the light-emitting units according to the plurality of power control signals, wherein the current difference controller outputs a plurality of power control signals having a first voltage level when the voltage levels of the plurality of feedback control signals are within a predetermined operating range, and outputs a plurality of power control signals having a second voltage level when the voltage level of at least one of the plurality of feedback control signals is out of the predetermined operating range.

* * * * *